US007322064B2

(12) United States Patent
Wu

(10) Patent No.: US 7,322,064 B2
(45) Date of Patent: Jan. 29, 2008

(54) INFLATABLE BED

(76) Inventor: Hsin-Tsai Wu, 1F, No. 19, Alley 3, Lane 106, Sec. 3, Min-Chuan E. Rd., Taipei City (TW)

( * ) Notice: Subject to any disclaimer, the term of this patent is extended or adjusted under 35 U.S.C. 154(b) by 545 days.

(21) Appl. No.: 10/848,842

(22) Filed: May 19, 2004

(65) Prior Publication Data

US 2005/0223495 A1 Oct. 13, 2005

(30) Foreign Application Priority Data

Apr. 9, 2004 (CN) ..... 2004 2 0036351

(51) Int. Cl.
*A47C 27/08* (2006.01)
*A47C 27/10* (2006.01)

(52) U.S. Cl. ..... 5/711; 5/706

(58) Field of Classification Search ..... 5/711, 5/710, 655.3, 644, 706, 713
See application file for complete search history.

(56) References Cited

U.S. PATENT DOCUMENTS 1,382,531 A * 6/1921 Newborn ..... 5/706
2,919,747 A * 1/1960 Post ..... 428/102
3,112,956 A * 12/1963 Schick et al. ..... 297/219.1
3,253,861 A * 5/1966 Howard ..... 297/452.43
4,442,838 A * 4/1984 Samson et al. ..... 607/85
4,459,714 A * 7/1984 Lin ..... 5/655.3
4,541,135 A * 9/1985 Karpov ..... 5/710
6,964,073 B1 * 11/2005 Curry ..... 5/626

* cited by examiner

*Primary Examiner*—Alexander Grosz
(74) *Attorney, Agent, or Firm*—Trop, Pruner & Hu, P.C.

(57) ABSTRACT

An inflatable bed includes bottom and top sheet layers, a surrounding sheet that interconnects the peripheral ends of the bottom and top sheet layers and that cooperates with the bottom and top sheet layers to form a bed body which defines an air chamber, a plurality of spaced-apart tension members disposed within the air chamber, and an inner partition sheet spaced apart from and surrounded by the surrounding sheet. Each tension member has two ends connected respectively to the bottom and top sheet layers. The inner partition sheet is connected to the bottom and top sheet layers so as to divide the air chamber into first and second air chambers. The first air chamber is defined between the surrounding sheet and the inner partition sheet.

9 Claims, 4 Drawing Sheets

INFLATABLE BED

BACKGROUND OF THE INVENTION

1. Field of the Invention

The invention relates to an inflatable bed, more particularly to an inflatable bed that has a rounded outer periphery and a varying height.

2. Description of the Related Art

Referring to FIG. 1, a currently available inflatable bed 1 is rectangular in shape after being inflated. The inflatable bed 1 includes bottom and top sheet layers 11, 12, a surrounding sheet 13 that interconnects end peripheries 111, 121 of the bottom and top sheet layers 11, 12 and that cooperates with the bottom and top sheet layers 11, 12 to confine an air chamber 16, a plurality of tension members 14, and an air valve 15. The tension members 14 have substantially same heights, and are disposed uniformly in the air chamber 16 along the length of the inflatable bed 1. Two ends of each of the tension members 14 are connected respectively to the bottom and top sheet layers 11, 12. The air valve 15 is in fluid communication with the air chamber 16 for inflation and deflation of the inflatable bed 1. However, this kind of rectangular inflatable bed 1 has a monotonous and dull appearance. Furthermore, when the middle portion of the inflatable bed 1 is pressed by the body weight of the user during use, air is forced to flow to the four corners of the inflatable bed 1 such that the middle portion of the bed 1 cannot maintain sufficient stiffness to provide a good supporting effect. Sleeping quality of the user is thus adversely affected, thereby leading to sores and aches in the waist and back of the user.

In addition, the inflatable bed 1 has the same height between the bottom and top sheet layers 11, 12, as shown in FIG. 2, so that the bed 1 has a uniform height after being inflated. When the user lies on the inflatable bed 1, a pillow 18 is necessary so as to conform to the physiological demand, that is, the head should be higher, whereas the feet should be lower. However, the pillow 18 only increases the burden of the user during an outdoor trip such that use of the inflatable bed 1 is somewhat inconvenient.

SUMMARY OF THE INVENTION

Therefore, the object of the present invention is to provide an inflatable bed that has a rounded outer periphery, that has a uniform stiffness to provide stable support, and that has a varying height to ergonomically fit the body of a user.

According to this invention, an inflatable bed comprises a bottom sheet layer having a first peripheral end, a top sheet layer disposed above the bottom sheet layer and having a second peripheral end, a surrounding sheet that interconnects the first and second peripheral ends and that cooperates with the bottom and top sheet layers to form a bed body which defines an air chamber, a plurality of spaced-apart tension members disposed within the air chamber, and an inner partition sheet disposed within the air chamber and spaced apart from and surrounded by the surrounding sheet. Each of the tension members has two ends connected respectively to the bottom and top sheet layers. The inner partition sheet is connected to the bottom and top sheet layers so as to divide the air chamber into a first air chamber and a second air chamber surrounded by the first air chamber. The first air chamber is defined between the surrounding sheet and the inner partition sheet.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
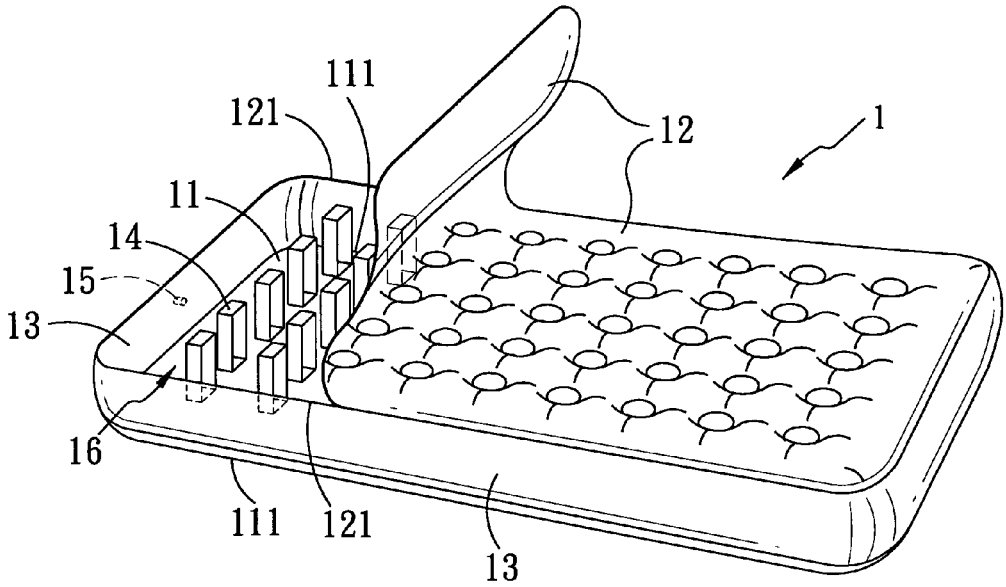
FIG. 1 PRIOR ART
FIG. 1 is a perspective view of a currently available inflatable bed, in which a portion of the interior thereof is exposed for the sake of clarity.
Figure 2:
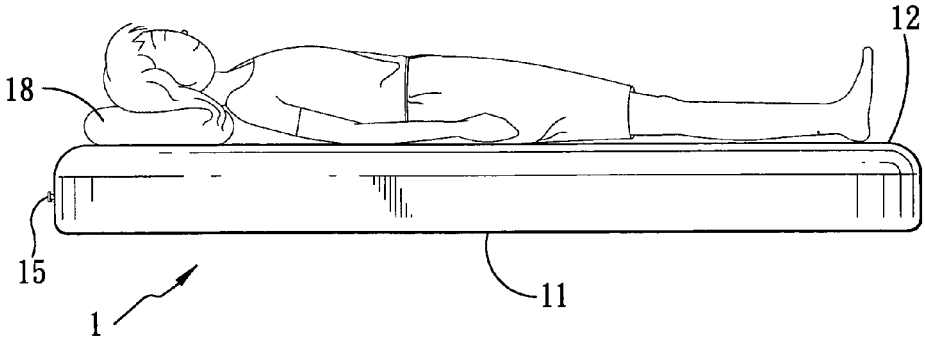
FIG. 2 PRIOR ART
FIG. 2 is a schematic side view of the inflatable bed of FIG. 1 in a state of use.

Before the present invention is described in greater detail, it should be noted that like elements are denoted by the same reference numerals throughout the disclosure.

Figure 3:
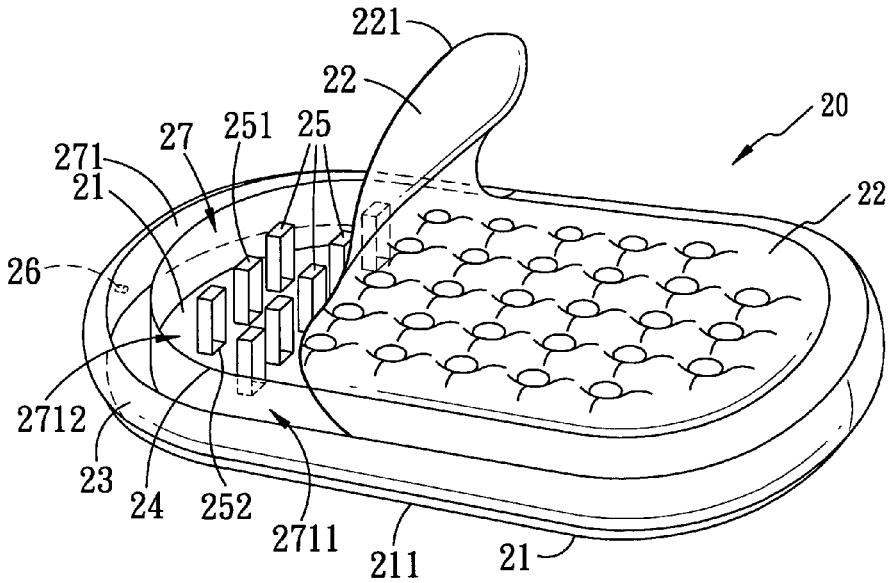
FIG. 3 is a perspective view of a preferred embodiment of an inflatable bed according to the present invention, in which a portion of the interior thereof is exposed for the sake of clarity.

Referring to FIG. 3, a preferred embodiment of an inflatable bed 20 according to the present invention is shown to comprise a bottom sheet layer 21, a top sheet layer 22, a surrounding sheet 23, an inner partition sheet 24, a plurality of tension members 25, and an air valve 26.

The bottom sheet layer 21 has an oval-shaped first peripheral end 211.

The top sheet layer 22 is disposed above the bottom sheet layer 21, and has an oval-shaped second peripheral end 221 that corresponds to the first peripheral end 211.

The surrounding sheet 23 interconnects the first and second peripheral ends 211, 221 of the bottom and top sheet layers 21, 22, and cooperates with the bottom and top sheet layers 21, 22 to form a bed body 27 which defines an air chamber 271.

The tension members 25 are disposed within the air chamber 271. Each of the tension members 25 has two ends 251, 252 connected respectively to the bottom and top sheet layers 21, 22. The function of the tension members 25 is to maintain a proper distance between the bottom and top sheet layers 21, 22 of the inflatable bed 20 after the latter is inflated.

The air valve 26 is in fluid communication with the air chamber 271 for inflation and deflation of the inflatable bed 1.

The inner partition sheet 24 is disposed within the air chamber 271, and is spaced apart from and surrounded by the surrounding sheet 23. The inner partition sheet 24 is connected to the bottom and top sheet layers 21, 22, thereby dividing the air chamber 271 into a first air chamber 2711 and a second air chamber 2712 surrounded by and in fluid communication with the first air chamber 2711. The first air chamber 2711 is defined between the surrounding sheet 23 and the inner partition sheet 24.

After the inflatable bed 20 is inflated, the bed 20 has the oval top sheet layer 22 surrounded by the surrounding sheet 23 so that the bed 20 will not have sharp corners such as those found in the currently available inflatable bed 1 (see FIG. 1). When a user lies on the top sheet layer 22, air in the middle portion of the bed 20 will not flow to corners, but will instead provide a uniform support at the middle portion, thereby resolving the drawback encountered in the currently available inflatable bed 1 (see FIG. 1) so that the sleeping quality of the user is enhanced. At this time, the first air chamber 2711 is formed as an air peripheral ring surrounding a periphery of the inflatable bed 20, and serves to reinforce the inflatable bed 20 so that the user is prevented from falling off the bed 20.

Figure 4:
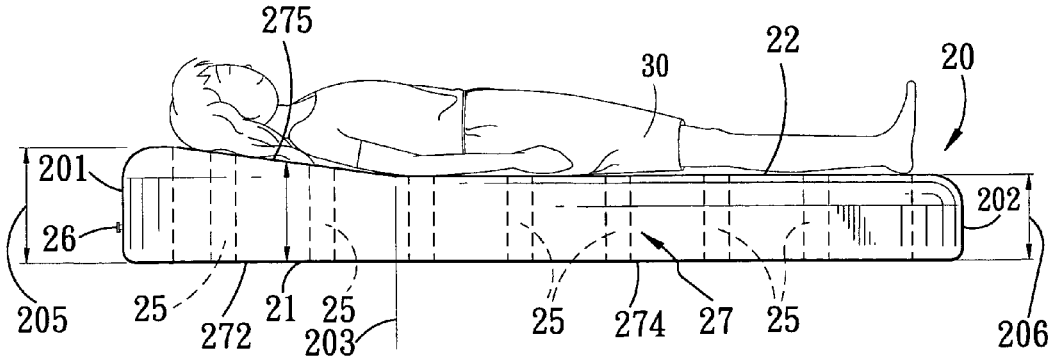
FIG. 4 is a schematic side view of another embodiment of an inflatable bed according to the present invention.

In another embodiment of the present invention, as shown in FIG. 4, the bed body 27 includes an upper body support portion 272, a lower body support portion 274, and a juncture 203 between the upper and lower body support portions 272, 274. The upper body support portion 272 has a first end 201. The lower body support portion 274 has a second end 202 opposite to the first end 201. The juncture 203 is located substantially below a part of the upper body of the user 30 adjacent to the shoulder when the user lies normally on the inflatable bed 20, and the length of the upper body support portion 272 is around one-third of the length of the inflatable bed 20 measured from the first end 201. The tension members 25 in the bed body 27 are adjusted during the production of the inflatable bed 20 so that the lengths of the tension members 25 in the upper body support portion 272 increase gradually from the juncture 203 toward the first end 201, while the lengths of the tension members 25 in the lower body support portion 274 are maintained uniformly from the juncture 203 toward the second end 202, and are shorter than those in the upper body support portion 272. As such, the height 205 of the bed body 27 at the first end 201 is greater than the height 206 of the bed body 27 at the second end 202 after the bed body 27 is inflated. An inclined support face 275 extends from the juncture 203 to the first end 201, and functions as a pillow so that the inflatable bed 20 conforms ergonomically to the body of the user.

Figure 5:
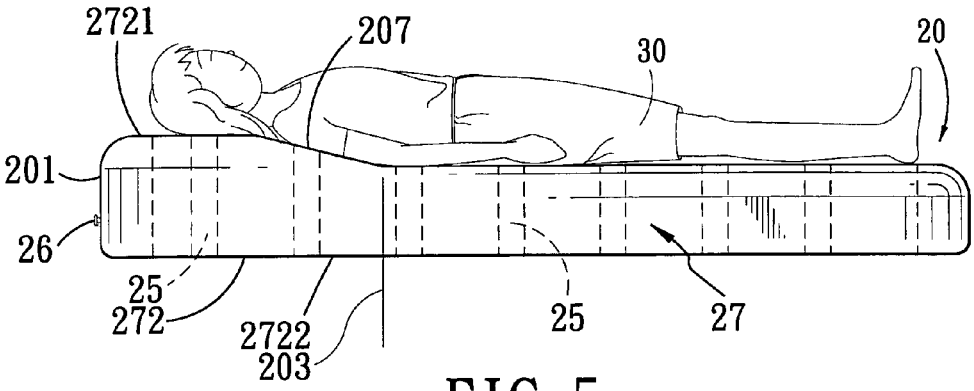
FIG. 5 is a schematic side view of still another embodiment of an inflatable bed according to the present invention.

In still another embodiment of the present invention, as shown in FIG. 5, the upper body support portion 272 of the inflatable bed 20 has a head region 2721 proximate to the first end 201, and a chest region 2722 proximate to the juncture 203. The lengths of the tension members 25 in the upper body support portion 272 increase gradually from the juncture 203 toward the chest region 2722, and maintain a uniform length from the head region 2722 toward the first end 201. An inclined support face 207 extends in the chest region 2722 between the juncture 203 and the head region 2721. An integral pillow is thus formed in the upper body support portion 272.

Figure 6:
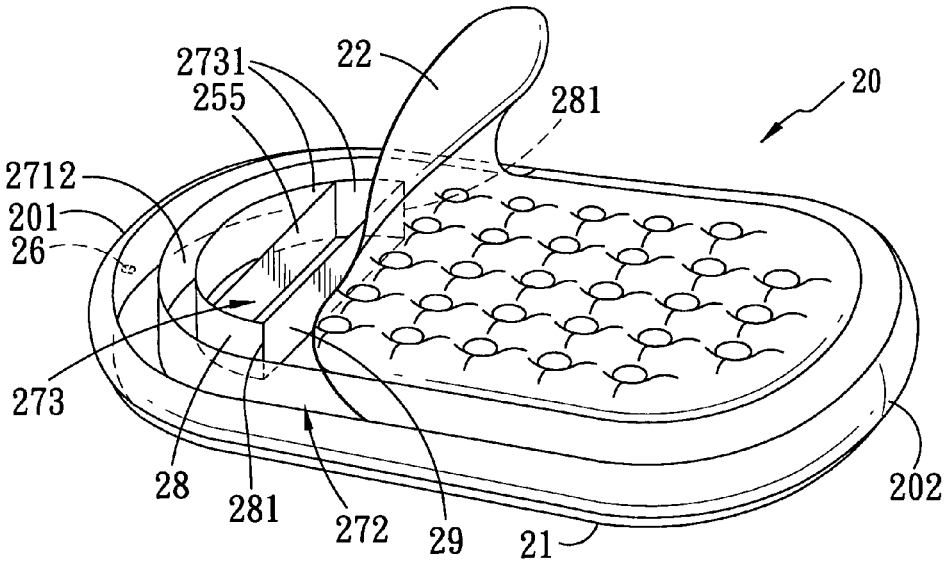
FIG. 6 is a perspective view of a further embodiment of an inflatable bed according to the present invention, in which a portion of the interior thereof is exposed for the sake of clarity.

In a further embodiment of the present invention, as shown in FIG. 6, the inflatable bed 20 further comprises first and second partition sheets 29, 28, and a reinforcing sheet 255. The first and second partition sheets 29, 28 confine a third air chamber 273 formed within the second air chamber 2712 in the upper body support portion 272. The first partition sheet 29 has top and bottom ends connected respectively to the top and bottom sheet layers 22, 21 and extending substantially along a first direction transverse to a line that extends from the first end 201 to the second end 202. The second partition sheet 28 is substantially U-shape, and has top and bottom ends connected respectively to the top and bottom sheet layers 22, 21, and two opposite ends 281 connected respectively to the first partition sheet 29. The third air chamber 273 is in fluid communication with the second air chamber 2712, and serves to function as a hidden pillow in this embodiment. The reinforcing sheet 255 extends along the first direction, and is disposed within the third air chamber 273. The reinforcing sheet 255 is connected to the second partition sheet 28 so as to divide the third air chamber 273 into two compartments 2731, thereby reinforcing the supporting function of the third air chamber 273.

Figure 7:
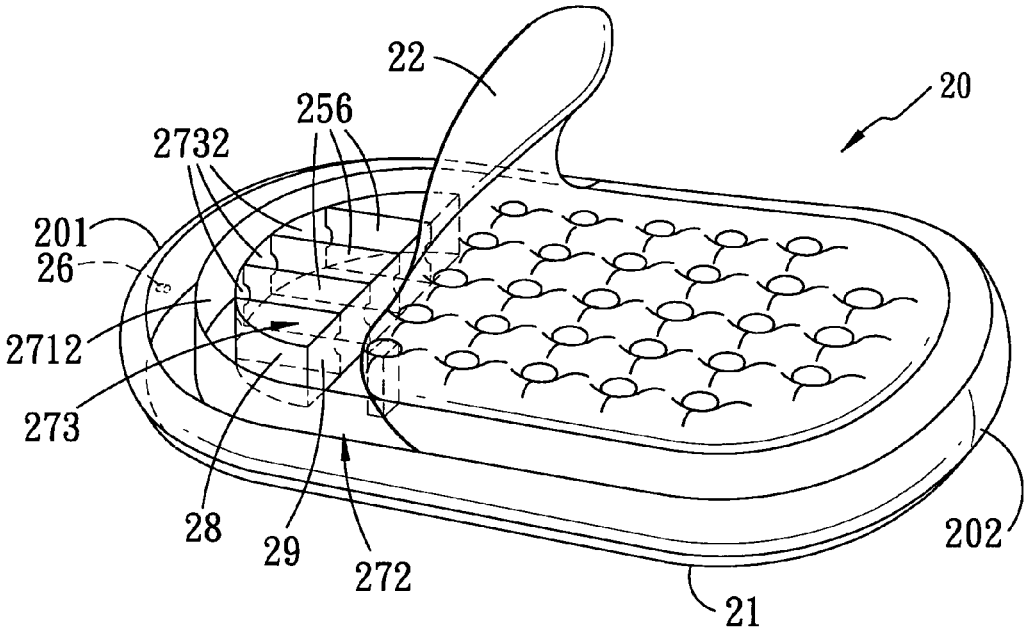
FIG. 7 is a perspective view of yet another embodiment of an inflatable bed according to the present invention, in which a portion of the interior thereof is exposed for the sake of clarity.

In yet another embodiment of the present invention, as shown in FIG. 7, the inflatable bed 20 further comprises first and second partition sheets 29, 28, and a plurality of reinforcing sheets 256. The first and second partition sheets 29, 28 confine a third air chamber 273 formed within the second air chamber 2712 in the upper body support portion 272. The first partition sheet 29 has top and bottom ends connected respectively to the top and bottom sheet layers 22, 21 and extending substantially along a first direction transverse to a line that extends from the first end 201 to the second end 202. The second partition sheet 28 is substantially U-shape, and has top and bottom ends connected respectively to the top and bottom sheet layers 22, 21, and two opposite ends 281 connected respectively to the first partition sheet 29. The third air chamber 273 is in fluid communication with the second air chamber 2712, and serves as a hidden pillow. The reinforcing sheets 256 extend along a second direction transverse to the first direction, and are disposed within the third air chamber 273. The reinforcing sheets 256 are connected to the first and second partition sheets 29, 28 so as to divide the third air chamber 273 into a plurality of compartments 2732.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An inflatable bed comprising:

a bottom sheet layer having a first peripheral end;

a top sheet layer disposed above said bottom sheet layer and having a second peripheral end;

a surrounding sheet that interconnects said first and second peripheral ends and that cooperates with said bottom and top sheet layers to form a bed body which defines an air chamber, wherein said bed body includes an upper body support portion, a lower body support portion, and a juncture between said upper and lower body support portions, said upper body support portion having a first end, said lower body support portion having a second end opposite to said first end;

a plurality of spaced-apart tension members disposed within said air chamber, each of said tension members having two ends connected respectively to said bottom and top sheet layers;

an inner partition sheet disposed within said air chamber and spaced apart from and surrounded by said surrounding sheet, said inner partition sheet being connected to said bottom and top sheet layers so as to divide said air chamber into a first air chamber and a second air chamber surrounded by said first air chamber, said first air chamber being defined between said surrounding sheet and said inner partition sheet; and first and second partition sheets which confine a third air chamber within said second air chamber in said upper body support portion, said first partition sheet having top and bottom ends connected respectively to said top and bottom sheet layers and extending substantially along a first direction transverse to a line that extends from said first end to said second end, said second partition sheet being substantially U-shape, and having top and bottom ends connected respectively to said top and bottom sheet layers, and two opposite ends connected respectively to said first partition sheet.

2. The inflatable bed as claimed in claim 1, wherein each of the first and second peripheral ends is oval-shaped.

3. The inflatable bed as claimed in claim 2, wherein the height of said bed body at said first end is greater than that of said bed body at said second end after said bed body is inflated.

4. The inflatable bed as claimed in claim 3, wherein said bed body has an inclined support face extending from said juncture to said first end.

5. The inflatable bed as claimed in claim 3, wherein said upper body support portion has a head region proximate to said first end, and a chest region proximate to said juncture, said bed body having an inclined support face extending in said chest region between said juncture and said head region.

6. The inflatable bed as claimed in claim 2, wherein said second air chamber is in fluid communication with said first air chamber.

7. The inflatable bed as claimed in claim 1, further comprising a reinforcing sheet extending along said first direction and disposed within said third air chamber to divide said third air chamber into a plurality of compartments.

8. The inflatable bed as claimed in claim 1, further comprising a reinforcing sheet extending along a second direction transverse to said first direction and disposed within said third air chamber to divide said third air chamber into a plurality of compartments.

9. The inflatable bed as claimed in claim 1, wherein said third air chamber is in fluid communication with said second air chamber.

* * * * *